US007531729B1

(12) United States Patent
Davis et al.

(10) Patent No.: US 7,531,729 B1
(45) Date of Patent: May 12, 2009

(54) NECK ASSEMBLY FOR A MUSICAL INSTRUMENT

(76) Inventors: Stephen Davis, 18 Hansel Rd., Newtown, PA (US) 18940; Richard Janes, 8 Arnold Rd., Worcester, MA (US); C. Malcolm Bash, 21 Washington Dr., Cranbury, NJ (US)

( * ) Notice: Subject to any disclaimer, the term of this patent is extended or adjusted under 35 U.S.C. 154(b) by 305 days.

(21) Appl. No.: 11/493,732

(22) Filed: Jul. 26, 2006

(51) Int. Cl.
*G10D 3/00* (2006.01)

(52) U.S. Cl. ..... 84/293

(58) Field of Classification Search ..... 84/267, 84/290, 293

See application file for complete search history.

(56) References Cited

U.S. PATENT DOCUMENTS

| | | | | |
|---|---|---|---|---|
| 4,145,948 A | | 3/1979 | Turner | 84/293 |
| 4,308,780 A | * | 1/1982 | Boucher | 84/293 |
| 4,846,039 A | | 7/1989 | Mosher | 84/293 |
| 4,950,437 A | | 8/1990 | Lieber | 264/257 |
| 4,951,542 A | | 8/1990 | Chen | 84/293 |
| 5,895,872 A | | 4/1999 | Chase | 84/291 |
| 6,046,393 A | * | 4/2000 | Rose | 84/293 |
| 6,100,458 A | | 8/2000 | Carrington et al. | 84/293 |
| 6,657,113 B2 | * | 12/2003 | Herman | 84/314 R |
| 6,888,055 B2 | | 5/2005 | Smith et al. | 84/293 |
| 6,965,065 B2 | | 11/2005 | McPherson | 84/293 |

* cited by examiner

*Primary Examiner*—Kimberly R Lockett
(74) *Attorney, Agent, or Firm*—LaMorte & Associates P.C.

(57) ABSTRACT

A neck assembly for a string instrument and the resulting string instrument. Resin reinforced fibers are shaped into the form of an instrument neck around a tubular structure. The tubular structure creates conduits within the neck. The conduits interconnect, thereby forming a single resonance chamber. The presence of the conduits decreases the weight of the neck. The result is a synthetic instrument neck that has a weight and acoustical properties comparable to a traditional wooden neck. The synthetic neck may also contains at least one mounting plate that enables the synthetic neck to be connected to many preexisting instrument bodies and tuning key heads. The synthetic instrument neck can therefore be retroactively added to existing instruments without the need for alterations.

17 Claims, 5 Drawing Sheets

NECK ASSEMBLY FOR A MUSICAL INSTRUMENT

BACKGROUND OF THE INVENTION

1. Field of the Invention

In general, the present invention relates to stringed musical instruments. More particularly, the present invention relates to the neck structure of stringed musical instruments.

2. Prior Art Description

Many stringed musical instruments, such as guitars, bass guitars, violins, cellos, and the like, have a neck structure that extends under the strings. Each string on such instruments is of different diameter, weight, and tension. In this manner, each of the strings on the instrument produces different musical tones when vibrated.

The strings of such instruments extend above the neck of the instrument. The tension produced by the strings is experienced along the neck of the instrument. Consequently, the neck must be strong enough to support the cumulative string tension created by the strings. The neck must also be rigid enough remain straight under the tension so that a constant string relief can be maintained in between the strings and the neck. Furthermore, the neck must not twist due to the asymmetric loading imposed by the various string tensions. Twisting would create an unplayable condition where one or more strings would touch the frets of the neck.

The traditional material for the neck of a stringed instrument is wood. Wood is used for its warm, tonal properties. However, wood has many disadvantages. Wood, being a natural material, can vary considerably within the same species. Wood may differ in strength, rigidity and tonal quality from piece-to-piece. Furthermore, wood is influenced by changes in temperature and humidity which causes the wood to expand and contract. In an instrument, the resulting dimensional changes affect the tone of the instrument.

In order to eliminate the many variables inherent in wooden necks, some instrument manufacturers have made necks with secondary materials that stabilize the wood. There are numerous examples in the prior art of composite materials being used to improve the performance of an instrument's neck. A popular design has been to use an internal wood core and provide fiber reinforcement around the exterior to retain the tonal properties of wood. Such prior art neck structures are exemplified by U.S. Pat. No. 4,950,437 to Lieber, entitled Molding Process For Musical Instrument Neck, and U.S. Pat. No. 4,951,542 to Chen, entitled Electric Guitar Neck.

In the prior art, wooden neck structures have also been reinforced with composite inserts that internally stabilize the wood. Such prior art is exemplified by U.S. Pat. No. 6,965,065 to McPherson, entitled, Neck For Stringed Musical Instrument and U.S. Pat. No. 6,888,055 to Smith and Blanda, entitled, Guitar Neck And Support Rod.

In the prior art record, instrument necks have been used that are totally synthetic and contain no wood at all. For instance, in U.S. Pat. No. 4,145,948 to Turner, entitled, Graphite Composite Neck For Stringed Musical Instruments, an instrument neck is shown that is made completely from a graphite (carbon) fiber reinforced plastic material. In U.S. Pat. No. 4,846,039 to Mosher, entitled, Neck For Stringed Musical Instruments, an instrument neck is described that is comprised of alternating layers of epoxy resin and powdered carbon. Finally, U.S. Pat. No. 6,100,458 to Carrington, entitled, Neck For Stringed Instrument, a neck structure is shown that is comprised of an internal foam core with exterior reinforcing fibers.

A problem associated with some synthetic instrument neck structures is that the synthetic necks tend to be solid and heavy. As a result, any instrument utilizing such a neck may have a different feel or balance as compared to the same instrument with a traditional wooden neck. This change in balance and increased weight is undesirable to many musicians.

In U.S. Pat. No. 5,895,872 to Chase, entitled Composite Structure For A Stringed Instrument, a lightweight synthetic neck assembly is shown. In this patent, a core material, such as dense foam, is wrapped with fiber reinforced resin, thereby forming the neck. The foam used to form such necks must be rather dense so that the foam core can withstand the wrapping and forming process without compressing out of its original shape.

The use of such dense foam neck structures does have disadvantages. In the Chase patent, the neck lacks the structure to be connected, such as with screws to the body of a guitar. Accordingly, in the Chase patent, the body of the guitar and the neck of the guitar had to be manufactured together as a single integral assembly in order to produce the stable interconnection needed between these components. Such a construction is clearly illustrated in FIG. 2 of the Chase patent. The result is that the neck of the Chase patent cannot be readily attached to conventional guitar bodies without requiring alterations to those guitar bodies.

Another disadvantage of dense foam filled neck structures, such as is shown in the Chase patent, is one of acoustics. When composite material is formed around a dense foam core, the dense foam core must be substantial enough to resist the external pressure of consolidation. As a result, the dense foam core must be heavy and dense in order to maintain significant structural strength. In addition, the dense foam core becomes trapped within the structure. The dense foam core absorbs sound energy. Consequently, the presence of the dense foam core limits the amount of resonance acoustics that can be achieved within the neck structure. Thus, an instrument neck having a foam core will have limited acoustical characteristics. In certain instruments, this absorption of sound may be desirable to prevent rattles and other extraneous sounds. However, in other instruments, the foam core may make the instrument sound "flat" due to the lack of harmonics in the neck.

With a compression molded foam core design, such as is found in the Chase patent, the removal of the foam core to create beneficial harmonics is not an option, because the foam core is an integral part of the neck structure.

A need therefore exists for an instrument neck structure that is synthetic and lightweight, yet has good acoustics, does not require a dense foam core, and can be added to existing instruments. This need is met by the present invention as described and claimed below.

SUMMARY OF THE INVENTION

The present invention is a neck assembly for a string instrument and the string instrument that utilizes such a neck assembly. String instruments have bodies and tuning key heads. The neck separates the instrument body from the tuning key head. The instrument's strings extend above the neck between the body and the tuning key head. The tone of the various strings is changed by selectively pressing the strings against the neck at different points as the strings are caused to vibrate.

The neck of the present invention has a synthetic composite structure. Fiber reinforced resins are shaped into the form of an instrument neck around a tubular structure. The tubular structure creates conduits within the neck. The conduits preferably interconnect, thereby forming a single resonance chamber. The presence of the conduits decreases the weight of the neck. An optional light weight foam core can be used in the conduits to modify the tonal response of the neck. The result is a synthetic instrument neck that has a weight and acoustical properties that are unique.

The synthetic neck also contains at least one mounting plate that enables the synthetic neck to be connected to many preexisting instrument bodies and tuning key heads. The synthetic instrument neck can therefore be retroactively added to existing instruments without the need for alterations.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be incorporated into many instruments, such as a violin, cello, base or banjo, the present invention is particularly well suited for use in a guitar. Accordingly, the present invention will be described embodied within a guitar in order to set forth one of the best modes contemplated for the invention. However, it will be understood that the choice of a guitar is merely exemplary and should not be considered a limitation to the application of the present invention to other instruments.

Figure 1:
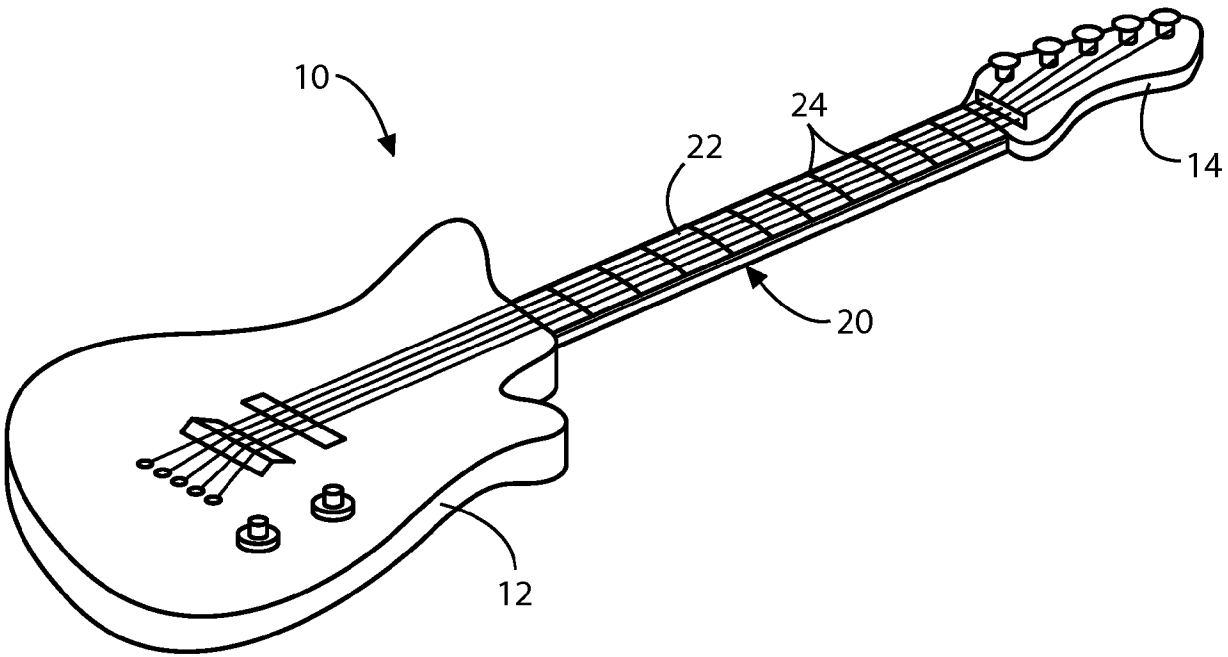
FIG. 1 is a perspective view of an exemplary string instrument in accordance with the present invention.

Referring to FIG. 1, there is shown a string instrument 10. The string instrument 10 is embodied as a guitar for the reasons previously explained. The string instrument 10 has a body 12 and a tuning key head 14. The instrument body 12 and the tuning key head 14 are separated by the neck assembly 20 of the string instrument. Strings 18 extend from the instrument body 12 to the tuning key head 14 across the top of the neck assembly 20. For a guitar, the neck assembly 20 has a flat top surface 22. Frets 24 are disposed along the length of the top surface 22 at predetermined points.

Figure 2:
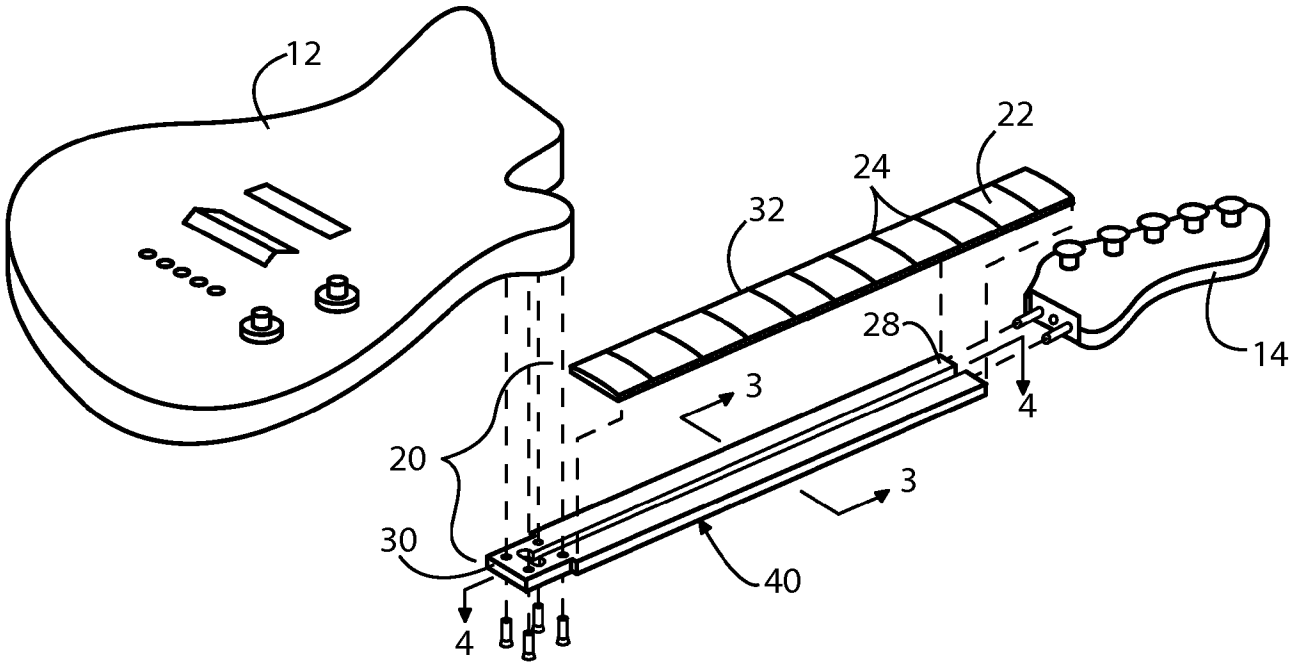
FIG. 2 is an exploded view of the embodiment of FIG. 1.

Referring to FIG. 2, it can be seen that the neck assembly 20 can be selectively detached from the instrument body 12. The instrument body 12 is a prior art instrument body. Accordingly, most any prior art instrument body can be adapted for use as part of the present invention. The neck assembly 20 attaches to the instrument body 12 through the use of mounting screws 26 that passes through the neck assembly 20 and into the back of the instrument body 12. In the embodiment of FIG. 2 the instrument body 12 represents a solid body for an electric guitar. It will be understood that an electric guitar is being illustrated only for example and that other instruments, such as acoustical guitars, have different neck attachment points and configurations. In the shown embodiment, the tuning key head 14 is also detachable from the neck assembly 20. This is only an exemplary construction. It will be understood that the tuning key head 14 may also be integrally formed as part of the neck assembly 20, as is traditional with most commercially available instrument necks. However, in the selected embodiment, the tuning key head 14 is a separate component that can be selectively attached to, and detached from, the neck assembly 20. In this manner, different tuning key heads 14 can be attached to the neck assembly 20 to suit the needs of the particular design.

Figure 3:
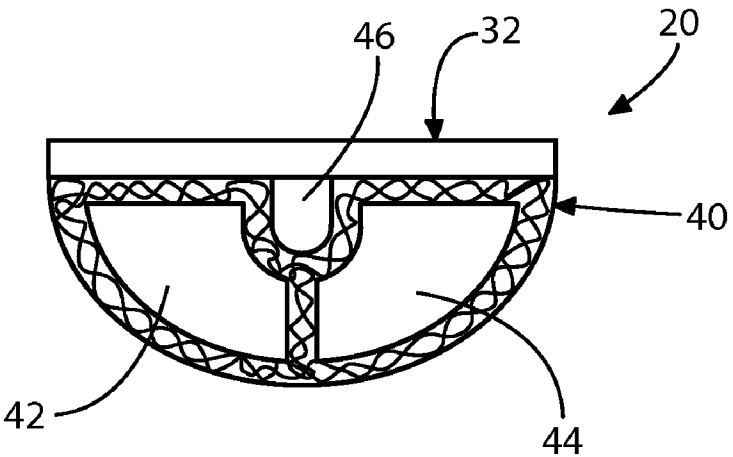
FIG. 3 is a cross sectional view of the support neck viewed along line 3-3 from FIG. 2, the support neck is shown in conjunction with a fingerboard.

The neck assembly 20 has a first end 28 and a second end 30. The first end 28 of the neck assembly 20 connects to the tuning key head 14. The second end 30 of the neck assembly 20 connects to the instrument body 12. Referring to FIG. 3 in conjunction with FIG. 1, it can be seen that the neck assembly 20 is comprised of a fingerboard 32 and a support neck 40. The fingerboard 32 lays flat across the top of the support neck 40. The fingerboard 32 contains the top surface 22 that is delineated at various points by protruding frets 24. Although the fingerboard 32 can be manufactured as an integral part of the support neck 40, the fingerboard 32 may also be molded separately, as is illustrated. The fingerboard 32 can be made of a variety of materials, such as the traditional wood or phenolic, or molded as a laminate of fiber reinforced resin. In the shown embodiment, the fingerboard 32 is made separately from the support neck 40 and is later bonded to the support neck 40 using adhesive, mechanical fasteners and/or heat bonding. As can be seen from FIG. 3, the support neck 40 defines a plurality of conduits. The conduits include a plurality of structural internal conduits 42, 44 and a truss rod conduit 46. The internal conduits 42, 44 are contained completely within the structure of the support neck 40. The truss rod conduit 46 is on the exterior of the support neck 40 and is disposed between the support neck 40 and the fingerboard 32. Such a position is merely exemplary and it should be understood that the truss rod conduit 46 can be disposed in the center of the support neck 40 or on the side of the support neck 40 that is opposite the fingerboard 32. The purpose of the truss rod conduit 46 is to accommodate a truss rod, often called the tension rod, which is a steel rod that can be selectively tightened or loosened to cause slight bending in the neck assembly 20. By selectively bending the neck assembly 20, a musician can make fine adjustments in the size of the gap between the strings 18 and the fingerboard 32.

Figure 4:
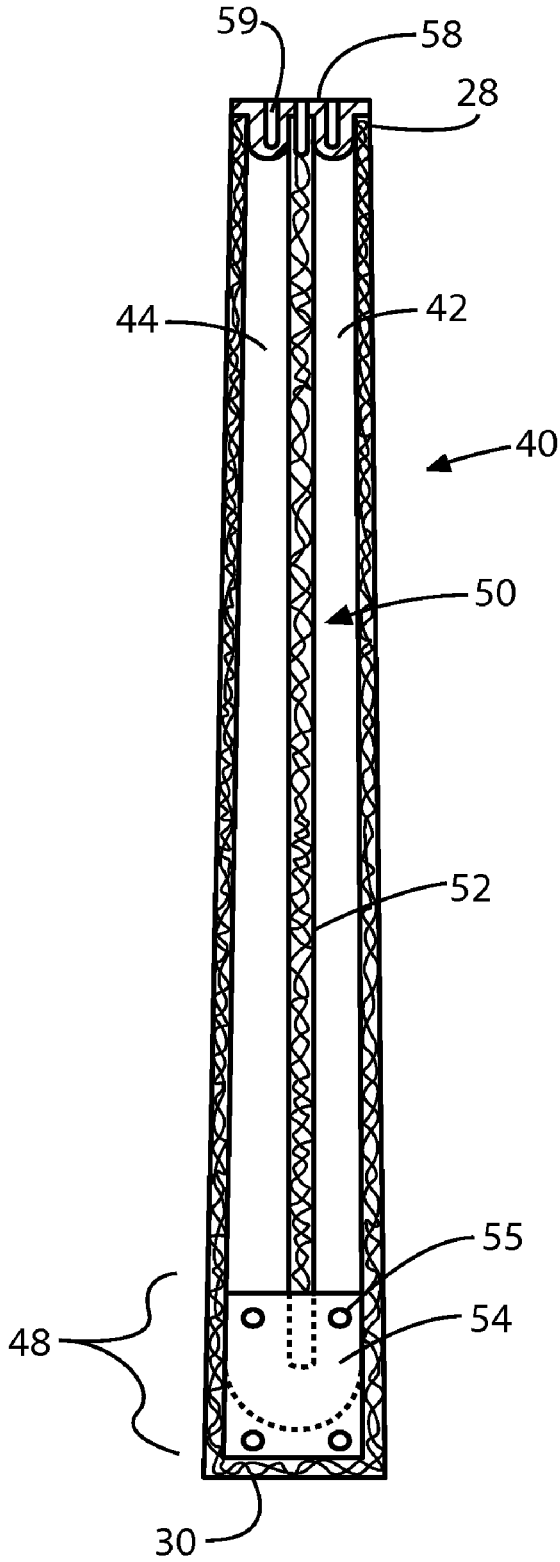
FIG. 4 is a cross sectional view of the support neck viewed along line 4-4 from FIG. 2.

Referring to FIG. 4, it can be seen that the support neck 40 has a heel section 48 proximate its second end 30. The internal conduits 42, 44 extend through the support neck 40. The internal conduits 42, 44 extend from the first end 28 of the support neck 40 down into the heel section 48. Once in the heel section 48, the internal conduits 42, 44 interconnect. In the shown embodiment, the two internal conduits 42, 44 are different sections of a single tubular structure 50. Effectively, there is only one tubular structure 50 within the support neck 40. The tubular structure 50 starts at the first end 28 of the support neck 40 and travels straight into the heel section 48 of the support neck 40, thereby creating the first internal conduit 42. Once in the heel section 48, the tubular structure 50 turns 180 degrees and heads back in a straight line to the first end 28 of the support neck 40, therein creating the second internal conduit 44. Since the tubular structure is turned upon itself, two sections of the tubular structure 50 conduit run side-by-side, creating the two internal conduits 42, 44.

The internal conduits 42, 44 are separated by a partition wall 52. The partition wall 52 extends the length of the conduit overlap and helps provide rigidity to the support neck 40.

The presence of the internal conduits 42, 44 makes the overall support neck 40 very light. The presence of the partition wall 52 ensures that the support neck 40 is rigid along its entire length. Furthermore, the tubular structure 50 that defines the internal conduits 42, 44 acts as a resonance chamber. Vibrations from the body of the instrument and from the strings of the instrument propagate back and forth in the tubular structure 50. If multiple unconnected conduits were used, each conduit would produce its own harmonics. The multiple harmonics maybe out of phase at different frequencies and would not produce good acoustical characteristics. The present invention uses only a single folded tubular structure 50. Since only one continuous tubular structure 50 is used, the vibrations produce only one set of harmonics. The long tubular structure 50 creates a sound wave of a longer length, therefore providing a richer tonal response. This provides the overall neck assembly 20 with improved acoustical properties.

In the shown embodiment, the tubular structure 50 only turns 180 degrees at the heel section 48 of the support neck 40. It should be understood that the tubular structure 50 can be turned at the first end 28 of the support neck 40 and again at the heel section 48. In such alternate embodiments, the tubular structure may run parallel to itself along three, four or five runs. In such embodiments, there would be multiple partition walls separating the different runs. However, in all cases, the tubular structure would be continuous between opposite ends.

The support neck 40 is preferably made of fiber reinforced resin, such as fiberglass or carbon fibers in an epoxy matrix. The fiber reinforced resin is molded into the shape of the support in a manner which will be later explained.

A first mounting plate 54 is set into the material of the support neck 40 neck in the heel section 48. The first mounting plate 54 defines a plurality of screw holes 55 into which mounting screws 26 (FIG. 2) can pass. The first mounting plate 54 is used to connect to the body of the string instrument. In the shown embodiment, the first mounting plate 54 lays in a plane parallel to the plane of the fingerboard 32 (FIG. 3). However, it will be understood that different types and models of instruments have different attachment points for the instrument neck. The first mounting plate therefore can be set in other planes, such as the plane perpendicular to the fingerboard, as used in an acoustic guitar. The size of the first mounting plate 54 and the position of the screw holes 55 depend upon the instrument on which the neck assembly is being attached.

From FIG. 4, it can be seen that a second mounting plate 58 is attached to the first end 28 of the support neck 40. The second mounting plate 58 contains screw holes 59 that enable the tuning key head 14 (FIG. 2) to be attached to the first end 28 of the support neck 40.

Figure 5:
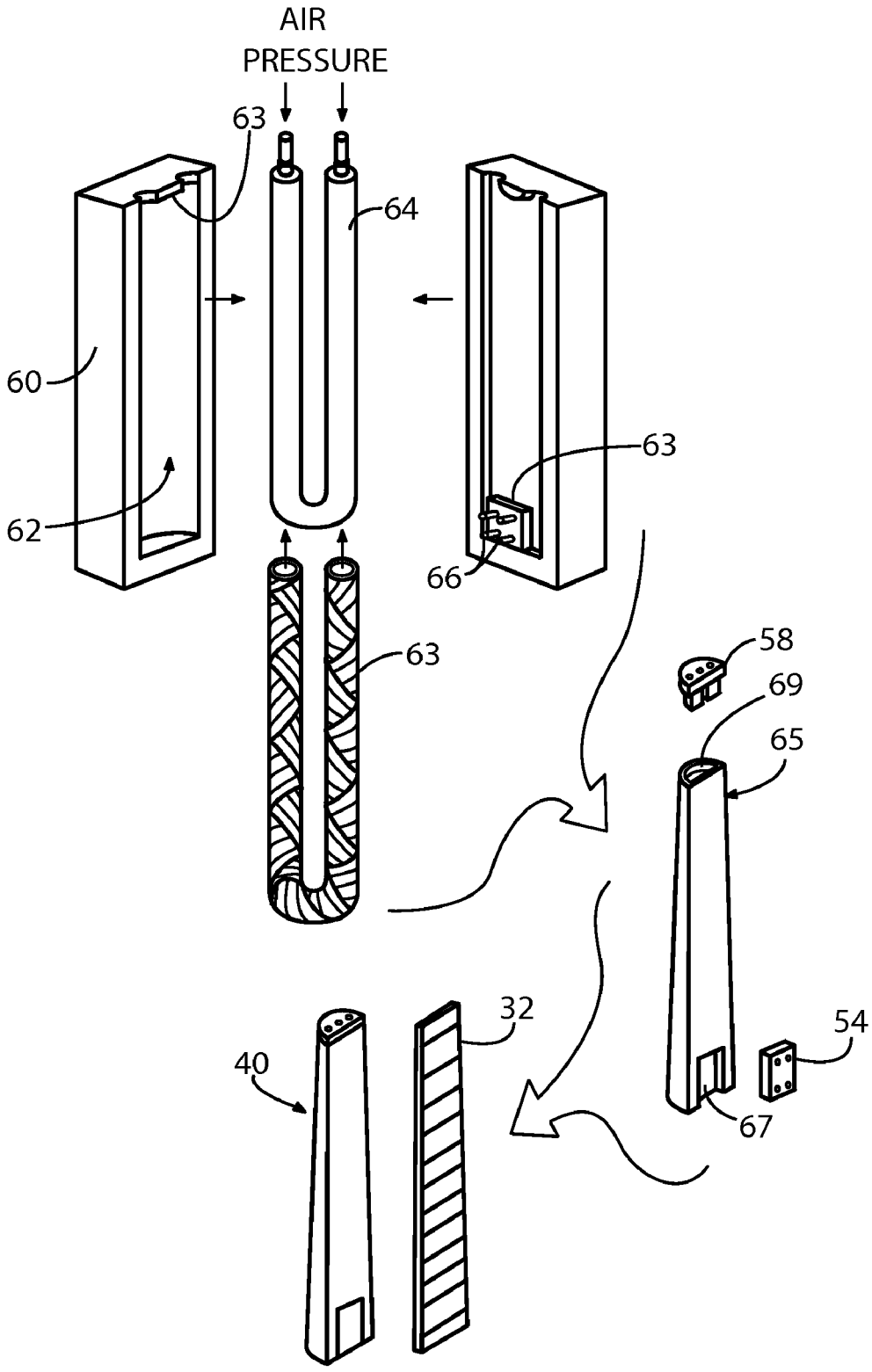
FIG. 5 is a schematic illustrating an exemplary method of manufacture.

Referring to FIG. 5, a method of manufacturing the present invention neck assembly can be described. In FIG. 5, a mold 60 is provided that contains a molding cavity 62 that has been cut into the desired shape of a support neck 40. The molding cavity 62 contains projections 63 that create recesses that later accept mounting plates.

The support neck has a composite structure. A common method of producing a composite structure is to start with a raw material in sheet form known as "prepreg" which are reinforcing fibers impregnated with a thermoset resin such as epoxy. The resin is in a "B Stage" liquid form which can be readily cured with the application of heat and pressure. The fibers can be woven like a fabric, or may be unidirectional. A variety of high performance reinforcement fibers can be selected, such as carbon, aramid, glass, fiberglass and the like. The prepreg material is in sheet form and is cut at various strip widths, lengths, and fiber angles to prepare what is known as a "lay-up". The lay-up is a combination of these strips which are overlapped and rolled up over a mandrel to form a prepreg tube perform 63. Another option is to braid the filaments into the prepreg tube perform 63. Yet another option is to use woven prepreg fabric and roll it into the prepreg tube perform 63.

In the shown embodiment, only a single bent prepreg tube form 63 is shown. It will be understood that multiple tube forms can be formed and then connected using prepreg strips to create the desired prepreg tube form.

Regardless of how the prepreg tube form 63 is formed, a bladder 64 is placed into the interior of the prepreg tube perform 63. The bladder 64 is inflated to expand the prepreg tube perform 63 during the forming process. If required, the prepreg tube form 63 is folded into its U-shape. The prepreg tube form 63 is then placed into the molding cavity 62. Pins 66 can optionally be inserted into the molding cavity 62 if apertures in the finished neck structure, such as screw holes, are desired. The mold 60 is pressed closed in a heated platen press. Air pressure within the prepreg tube perform 63 is maintained to retain the size and position of the prepreg tube perform 63. As the temperature rises in the mold 60, the viscosity of the epoxy resin decreases and the bladder 64 expands. This causes the prepreg tube perform 63 to fill the mold until expansion is complete and the epoxy resin is cross-linked and cured. The mold 60 is then opened and the part is removed from the mold. The bladder 64 is removed and a rough support neck 65 is formed. The rough support neck 65 is cut to length and cleaned of flashing.

The rough support neck 65 has recess 67 in its structure. The first mounting plate 54 is set into the recess 67 and is bonded in place using either adhesive and/or heat bonding. The second mounting plate 58 is set into the open end of the rough neck support 65 and is bonded in place in the same manner. If the rough support neck 65 is longer than is desired, the rough support neck 65 can be cut to length prior to the application of the second mounting plate 58.

Once the mounting plates 54, 58 are set in place, the rough support neck 65 is cleaned of flashing, thereby producing a finished support neck 40.

Prior to the support neck 40 being used in an instrument, a fingerboard 32 is bonded to the support neck 40, therein completing the neck assembly. If a truss rod is to be used, the truss rod is installed prior to the attachment of the fingerboard 32. Optionally, material such as foam or even a liquid can be sealed in the support neck 40 to achieve different acoustical properties. It will be understood that the embodiment of the present invention assembly and method that have been illustrated are merely exemplary and that a person skilled in the art can make variations to the shown embodiment without departing from the intended scope of the invention. For instance, the neck assembly can vary widely in shape depending upon the instrument for which it is intended. Furthermore, the number of turns used in the tubular structure and the internal diameter of the tubular structure can also be varied. All such variations, modifications and alternate embodiments are intended to be included within the scope of the present invention as defined by the claims.

What is claimed is:

1. A neck assembly for a musical instrument, comprising:

a support neck having a first end, a second end, and a heel section proximate said second end, said support neck defining a plurality of internal conduits that run in parallel through a portion of said support neck, wherein each of said plurality of internal conduits is separated by a partition wall within at least part of said portion of said support neck.

2. The assembly according to claim 1, further including a fingerboard supported by said support neck.

3. The assembly according to claim 1, wherein said plurality of internal conduits are part of a single bent tubular structure.

4. The assembly according to claim 3, wherein said tubular structure is generally U-shaped having two parallel sections and a single curve.

5. The assembly according to claim 4, wherein said single curve is present in said heel section of said support neck.

6. The assembly according to claim 1, further including a first mounting plate supported by said support neck proximate said second end.

7. The assembly according to claim 6, further including a second mounting plate supported by said support neck proximate said first end.

8. The assembly according to claim 1, wherein at least two of said internal conduits interconnect within said heel section.

9. A string instrument assembly, comprising:

a body;

a tuning key head; and a neck structure extending between said body and said tuning key head, wherein said neck structure contains a plurality of internal conduits that interconnect within said neck structure, a first mounting plate for mounting to said body, and a second mounting plate for mounting to said tuning key head.

10. The assembly according to claim 9, wherein said neck structure is selectively attached to said body with removable mechanical fasteners.

11. The assembly according to claim 9, wherein said tuning key head is selectively attached to said neck structure with removable mechanical fasteners.

12. The assembly according to claim 9, wherein said plurality of internal conduits are part of a single bent tubular structure.

13. The assembly according to claim 12, wherein said tubular structure is generally U-shaped having two parallel sections and a single curve.

14. The assembly according to claim 9, wherein said neck structure contains resin reinforced fibers.

15. A method of forming a neck structure for a string instrument, said method comprising the steps of:

forming fiber reinforced resin into a tubular structure;

bending said tubular structure into a preliminary form where sections of said tubular structure run in parallel; and placing said preliminary form into a heated mold and shaping said preliminary form into an instrument neck, wherein said tubular structure defines a conduit that runs internal of said instrument neck.

16. The method according to claim 15, further including the step of inflating said tubular structure within said heated mold.

17. The method according to claim 16, wherein the step of inflating said tubular structure includes placing at least one bladder into said tubular structure and inflating said bladder.

* * * * *